US005618187A

United States Patent [19]

Goto

[11] Patent Number: 5,618,187

[45] Date of Patent: Apr. 8, 1997

[54] BOARD MOUNT BUS BAR CONTACT

[75] Inventor: Kazuhiro Goto, Markham, Canada

[73] Assignee: The Whitaker Corporation, Wilmington, Del.

[21] Appl. No.: 391,941

[22] Filed: Feb. 21, 1995

Related U.S. Application Data

[63] Continuation-in-part of Ser. No. 340,934, Nov. 17, 1994.

[51] Int. Cl.[6] ..... H01R 9/09

[52] U.S. Cl. ..... 439/79; 439/947

[58] Field of Search ..... 439/82–83, 59–64, 439/79–81, 856–857, 947

[56] References Cited

U.S. PATENT DOCUMENTS

| | | | |
|---|---|---|---|
| 3,262,088 | 7/1966 | West | 339/258 |
| 4,003,617 | 1/1977 | Witek, Jr. et al. | 339/17 |
| 4,252,389 | 2/1981 | Olsson | 339/17 |
| 4,314,312 | 2/1982 | Donmoyer et al. | 361/400 |
| 4,541,034 | 9/1985 | Fanning | 439/83 |
| 4,545,634 | 10/1985 | Saijo | 439/83 |
| 4,684,191 | 8/1987 | Feher et al. | 439/246 |
| 4,818,237 | 4/1989 | Weber | 439/693 |
| 4,845,589 | 7/1989 | Weidler et al. | 361/342 |
| 4,857,018 | 8/1989 | Pickles | 439/82 |
| 4,904,192 | 2/1990 | Holden et al. | 439/78 |
| 4,932,906 | 6/1990 | Kaley et al. | 439/857 |
| 4,993,975 | 2/1991 | Asick et al. | 439/751 |
| 5,073,118 | 12/1991 | Grabbe et al. | 439/82 |
| 5,120,257 | 6/1992 | Hahn | 439/82 |
| 5,199,886 | 4/1993 | Patterson | 439/79 |
| 5,376,012 | 12/1994 | Clark | 439/80 |

*Primary Examiner*—Neil Abrams
*Assistant Examiner*—Brian J. Biggi

[57] ABSTRACT

A bus bar contact (10) for mounting on a circuit board having a U-shaped section, contact fingers (20), mounting tabs (26), and termination posts (30,32) extending therefrom. Guide means, which comprises a guide slot (44) in the circuit board or guide tabs (52) on the contact, is provided to protect the contact fingers from damage due to improper insertion. Securing means, which comprises mounting holes or bent portions of the solder tabs, is provided to secure the contact to the circuit board.

17 Claims, 5 Drawing Sheets

FIG. 6
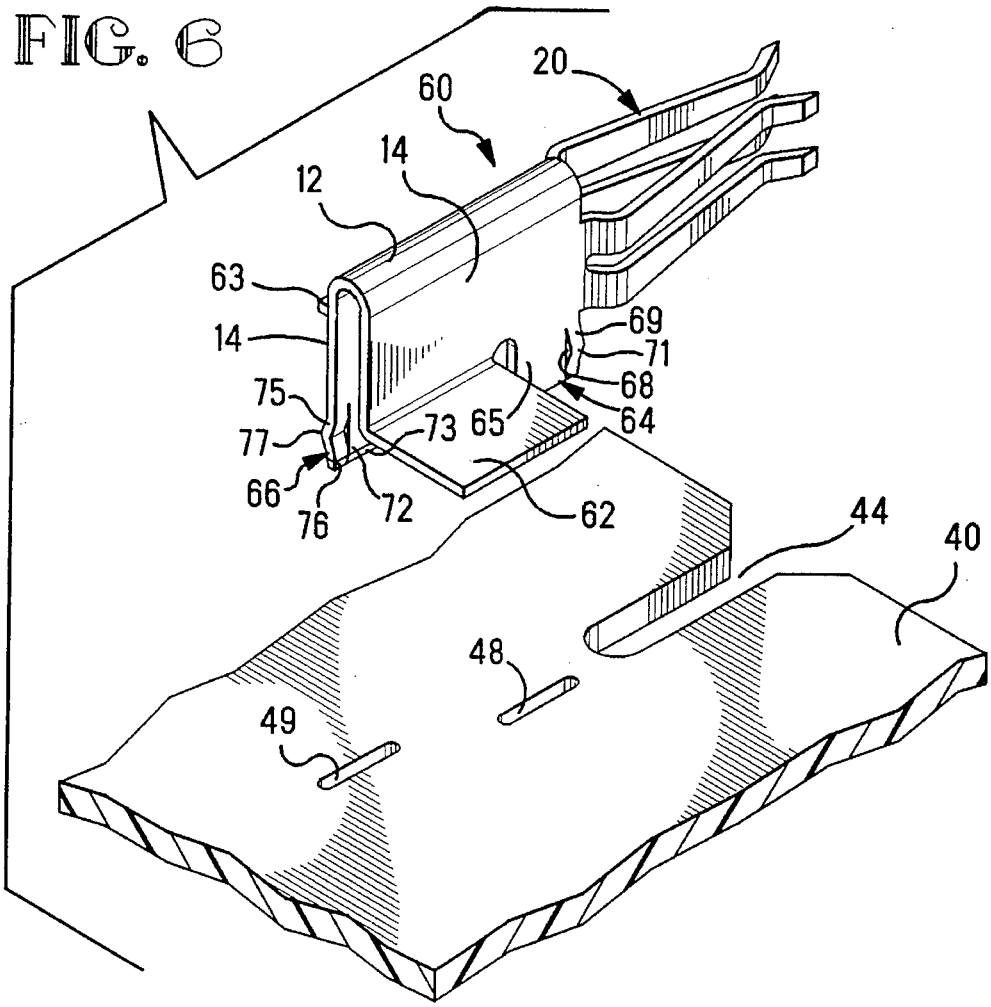
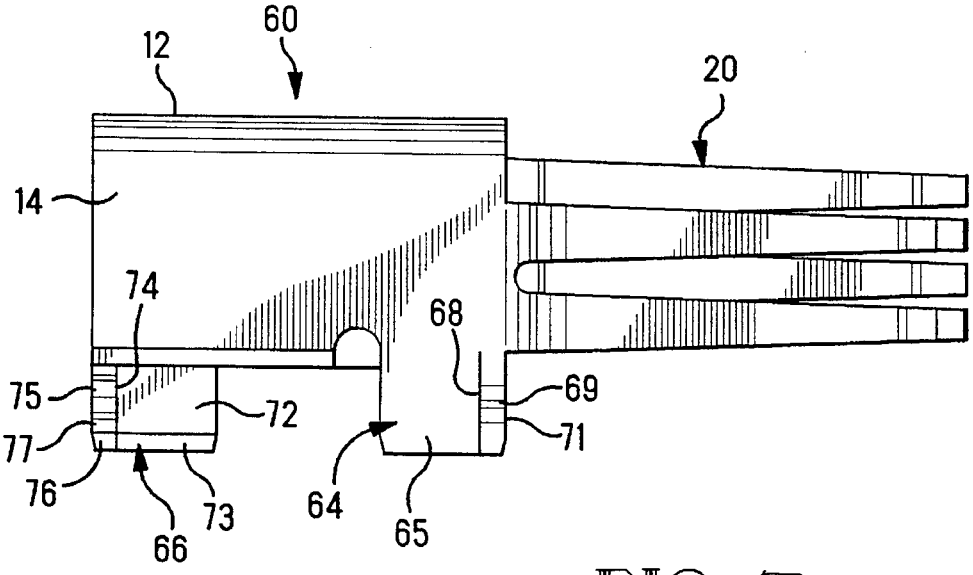
FIG. 7

BOARD MOUNT BUS BAR CONTACT

This application is a Continuation-In-Part of Ser. No. 08/340,934 filed Nov. 17, 1994.

FIELD OF THE INVENTION

The present invention relates to a bus bar contact for providing electrical connection to a circuit board.

BACKGROUND OF THE INVENTION

A typical bus bar contact is illustrated in U.S. Pat. No. 4,845,589. The contact has a center U-shaped section having contact fingers and a mounting section extending therefrom. The mounting section is used to both secure the contact and to provide the electrical connection. The contact is also mounted along with a guide means such as a guide fork which is used to protect the contact fingers from damage due to improper alignment during insertion of the matable contact.

When the contact is connected to a circuit board, it would be an advantage to have the guide member as an integral part of the contact or alternatively to be a part of a circuit board. It would also be an advantage to have the electrical connection to the circuit board to be provided by way of solder tails on the contact.

SUMMARY OF THE INVENTION

The current invention is realized by a bus bar contact for mounting on a circuit board which comprises a U-shaped section, contact fingers extending from the U-shaped section, termination posts extending downwardly from the U-shaped section to be received in holes in the circuit board for soldering thereto, mounting tabs extending outwardly from the U-shaped section, securing means for securing the contact to a circuit board, and guide means for guiding a matable contact into electrical connection with the bus bar contact.

The guide means is a slot in the circuit board, centrally disposed below the contact fingers, for guiding the matable contact into electrical connection with the bus bar contact and for protecting the contact fingers from damage due to improper insertion of the matable contact.

Alternatively, the guide means comprises integral guide tabs extending forwardly from the mounting tabs. The guide tabs have a guide slot disposed centrally below the contact fingers for guiding the matable contact into electrical connection with the bus bar contact and for protecting the contact fingers from damage due to improper insertion of the matable contact.

The securing means comprises mounting holes disposed in said tabs for receiving a screw or a fastener. Alternatively, the termination posts comprise solder tabs and the securing means comprises a bent portion for engaging the circuit board and securing the bus bar contact thereto.

BRIEF DESCRIPTION OF THE DRAWINGS

Embodiments of the present invention will now be described by way of example with reference to the accompanying drawings, in which:

FIG. 6 is an exploded perspective view of another embodiment of a bus bar contact and a circuit board.

FIG. 7 is a side view of the contact shown in FIG. 6.

DETAILED DESCRIPTION OF THE INVENTION

Figure 1:
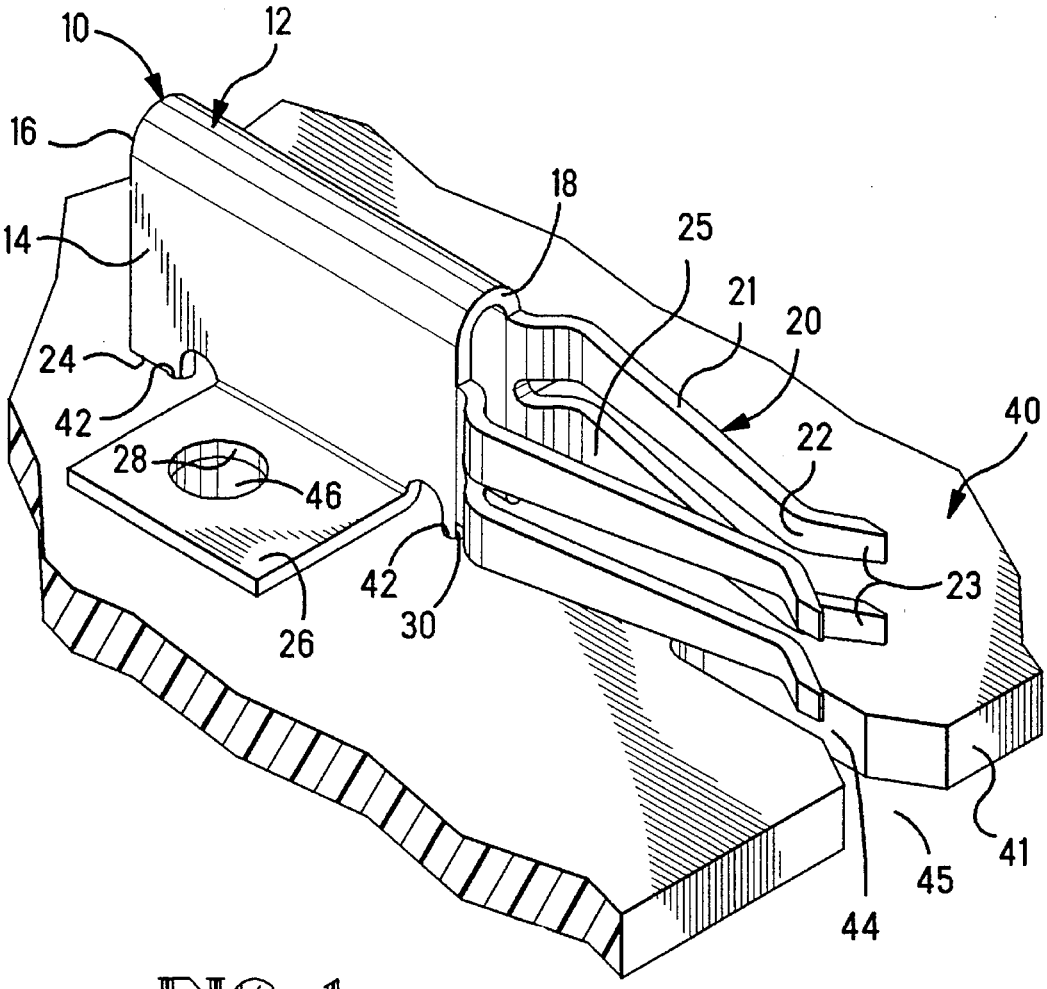
FIG. 1 is a perspective view of the bus bar contact and a circuit board of the current invention.

The bus bar contact 10 of the current invention is illustrated in FIG. 1. The contact 10 is mounted onto a circuit board 40 to supply power to the circuit board. Alternatively, the bus contact 10 could be used to supply an electrical signal or a ground connection to the circuit board.

Figure 4:
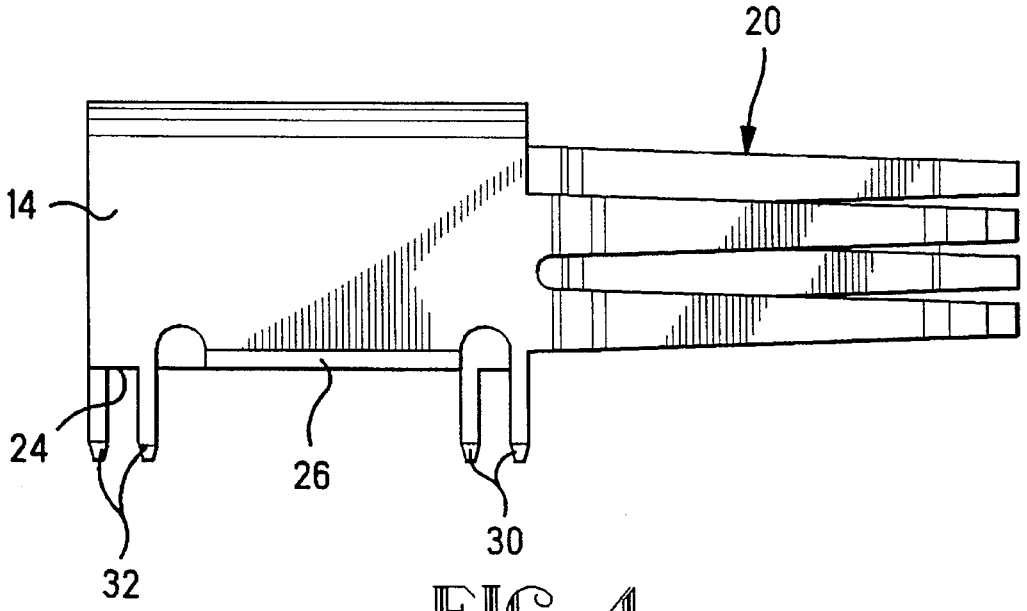
FIG. 4 is a side plan view of the bus bar contact.

The contact 10 is formed from a metal blank and stamped from a suitable metal and includes a central U-shaped portion 12. The U-shaped section 12 includes parallel legs 14 and a curved section 16 connecting the legs 14. The central U-shaped section 12 has a front end 18. Contact fingers 20 extend from the front end 18 of the U-shaped section 12 by extending from both legs 14, and they include outwardly curved portions 21, inwardly directed linear portions forming contact sections 22, and outwardly directed front ends 23 forming camming surfaces. The contact fingers 20 are alternated on the legs 14 in this embodiment, see FIG. 4, however, they could also be arranged in some other configuration, such as oppositely disposed on the legs 14. The junctions between contact sections 22 and front ends 23 are raduissed thereby forming contact engaging areas that are located in a plane. The contact fingers 20 form a generally triangular-shaped channel 25 therebetween for receiving a matable contact (not shown). The contact fingers 20 are cammed apart when a matable contact is inserted therebetween and are resiliently biased against the matable contact to insure good electrical connection between the bus bar contact 10 and the matable contact.

The legs 14 have ends 24 oppositely disposed from each other. The ends 24 have mounting tabs 26 extending outwardly therefrom, perpendicular to the legs 14. Mounting tabs 26 have holes 28 for securing the contact 10 to the circuit board 40.

The legs 14 also have termination posts 30, 32 extending from the ends 24. One set of termination posts 30 are located near the front of the contact 10. The other set of termination posts 32 are located near the back of the contact 10. The termination posts 30, 32 extend downwardly from the U-shaped section for electrical connection to the circuit board 40, the posts are preferably staggered.

Figure 2:
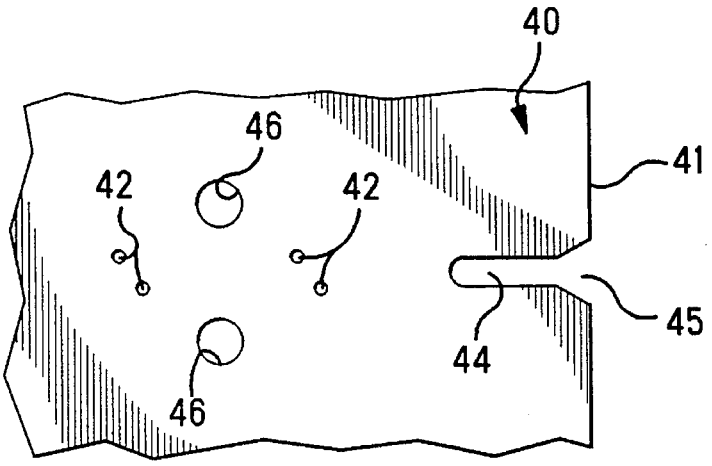
FIG. 2 is a top plan view of the circuit board showing the guide means.
Figure 3:
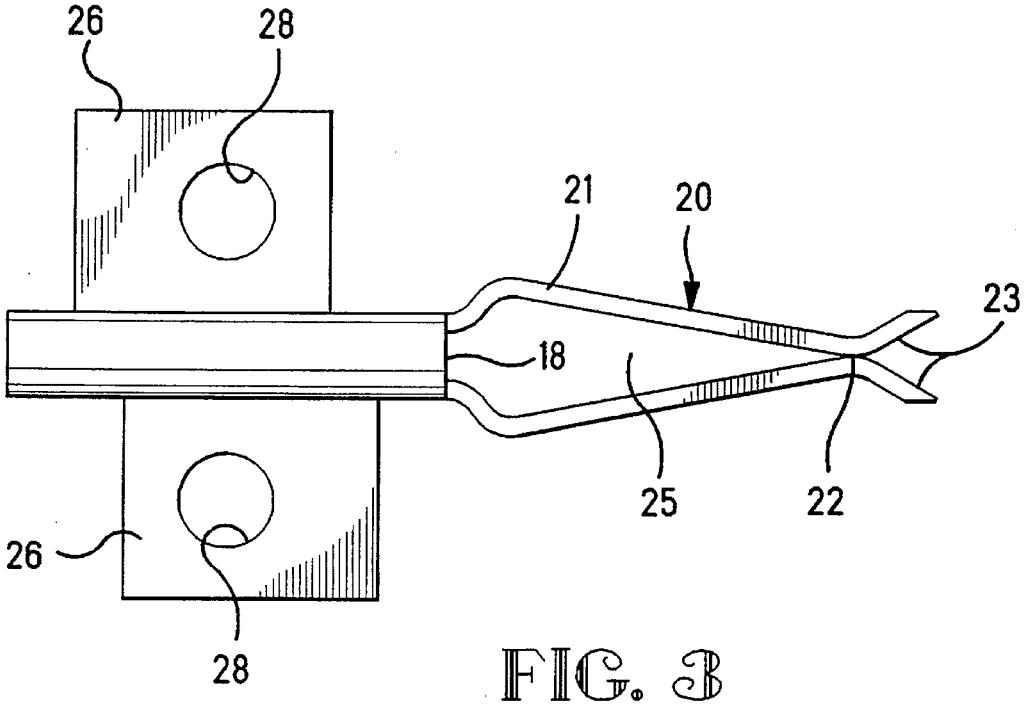
FIG. 3 is a top plan view of the bus bar contact.

Circuit board 40 has apertures 42 for receiving the termination posts 30, 32 for electrical connection of the contact 10 with the circuit board 40, see FIG. 2. The termination posts 30, 32 are soldered in the apertures 42 to ensure electrical connection with traces on the circuit board 40. Circuit board 40 also has holes 46 which are in alignment with the holes 28 on the mounting tabs 26. The holes 46 are used to secure the plugs 10 to the circuit board 40 by means of a fastener, screw or some other securing means and to provide greater stabilization than would be provided if the contact 10 was only soldered to the board 40 via the posts 30,32. When the contact 10 is mounted and secured to the board, the contact fingers 20 are near the end 41 of the board 40 and do not extend beyond the end 41 of the board 40.

In order to protect the contacts from damage due to an improperly inserted matable contact, a means for guiding the matable contact is provided. Circuit board 40 has a guide slot 44 disposed in the board 40. The guide slot has an opening 45 along the end 41 of the board and extends so that the slot 44 is centrally aligned beneath the contact fingers 20. A matable contact is received into the opening 45 of the slot 44 and guides the matable contact into electrical contact with the contact fingers 20.

Figure 5:
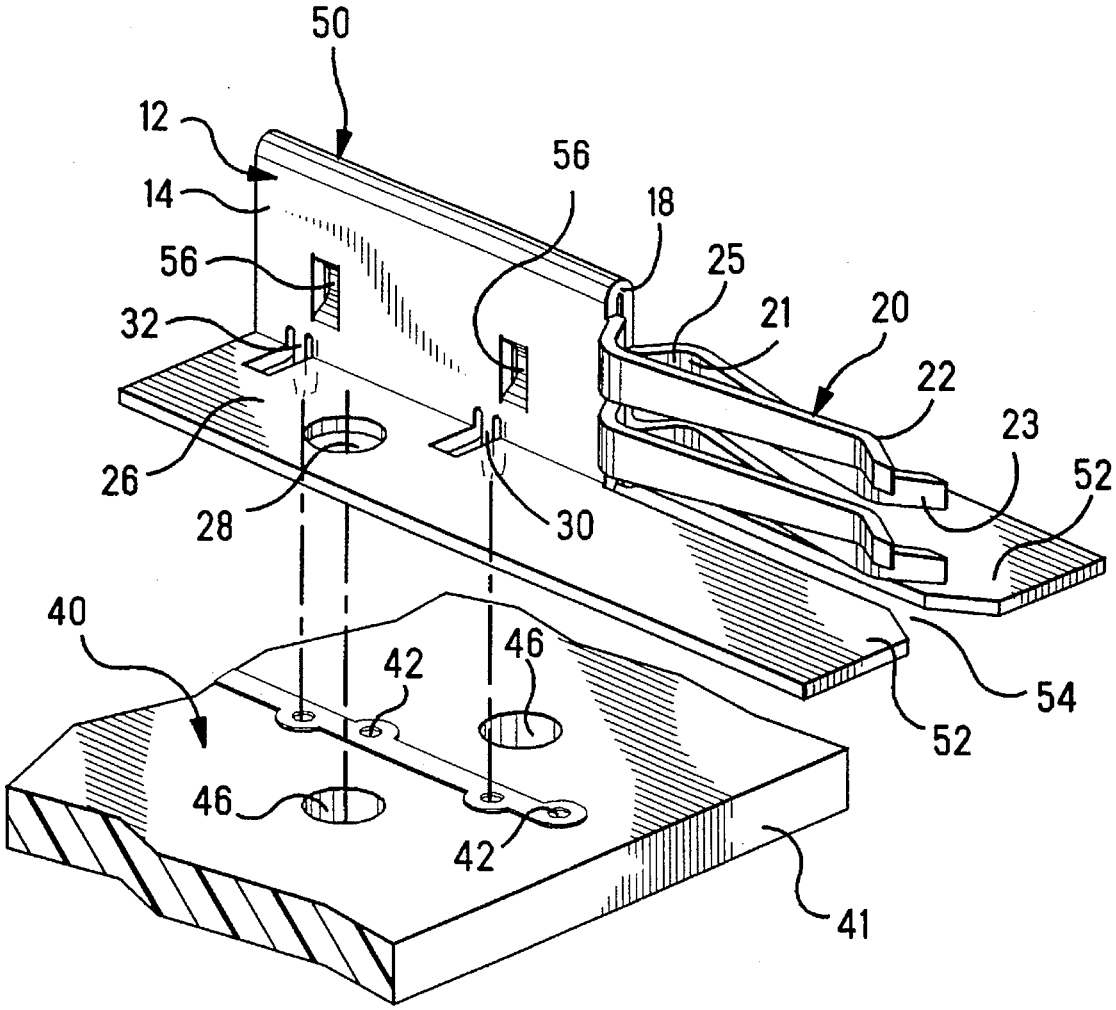
FIG. 5 is an exploded perspective view of an alternative embodiment of a bus bar contact of the current invention and a circuit board.
Figure 8:
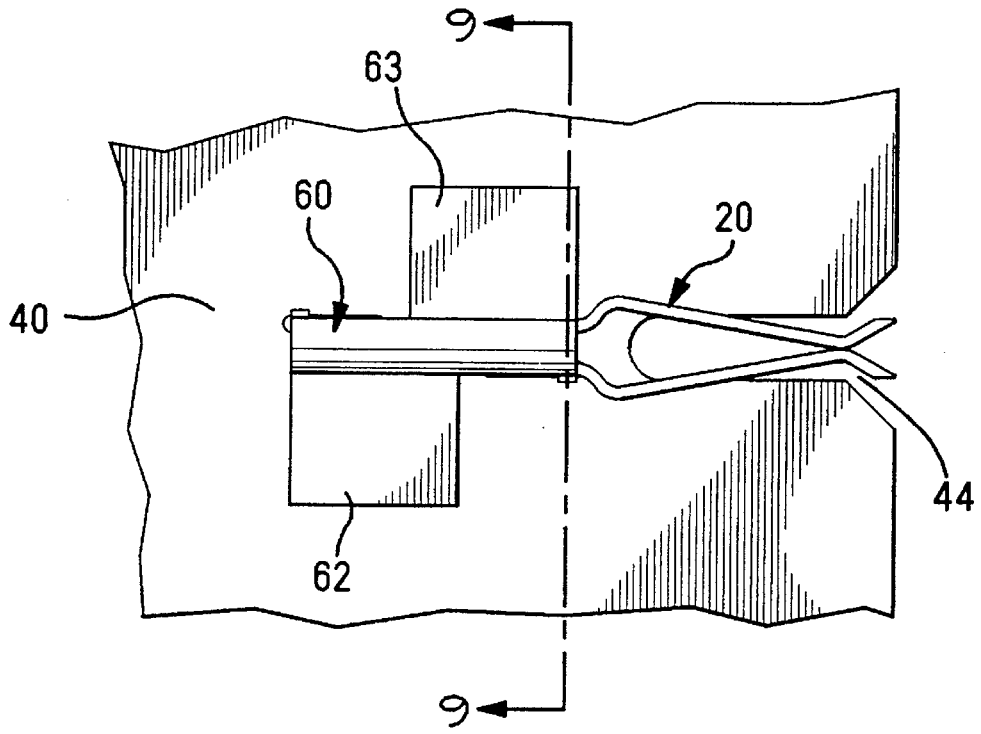
FIG. 8 is a top view of the contact and the circuit board.

FIG. 5 illustrates an alternative embodiment of the present invention in which like features will have the same reference numerals. Contact 50 has a central U-shaped section having contact fingers 20, mounting tabs 26, and termination posts 30, 32 extending therefrom.

The mounting tabs 26 have integral guide tabs 52 extending forwardly therefrom. The guide tabs 52 are disposed below and on either side of the contact fingers 20. A guide slot 54 is disposed between the guide tabs 52 and is centrally located below the contact fingers 20. When the contact 50 is mounted on the circuit board 40, the guide tabs 52 and the contact fingers 20 extend beyond the edge 41 of the circuit board 40. Guide tabs 52 then serve to guide the matable connector into the guide slot 54 and between the contact fingers 20 to prevent the contact fingers 20 from being damaged due to improper insertion of a matable connector. Contact 50 further has lances 56 punched into the U-shaped section 12. The lances 56 secure the parallel legs 14 of the U-shaped section 12 together and therefore provide greater strength to the U-shaped section 12. Staggered termination posts 30, 32 are stamped from guide tabs 52 and extend therebelow in alignment with legs 14.

Another alternative embodiment of the present invention is shown in FIG. 6 in which like features will have the same reference numerals. Contact 60 has a U-shaped portion 12 with legs 14 extending downwardly. Contact fingers 20 extend forwardly for electrical connection with the matable contact. The contact 60 has stabilization tabs 62,63 extending perpendicularly from the legs 14. Stabilization tab 63 is positioned forward from stabilization tab 62 to provide better stability of the contact 60 on the circuit board 40. Contact 60 has termination posts which are in the form of solder tabs 64, 66 which extend downwardly from legs 14. Solder tab 64 is positioned proximate to the contact fingers 20 whereas solder tab 66 is positioned along the back section of the contact 60. The solder tabs are to be received in tab holes 48,49 which are positioned on the circuit board 40. The solder tabs 64,66 are soldered to the circuit board and provide electrical connection thereto.

Figure 9:
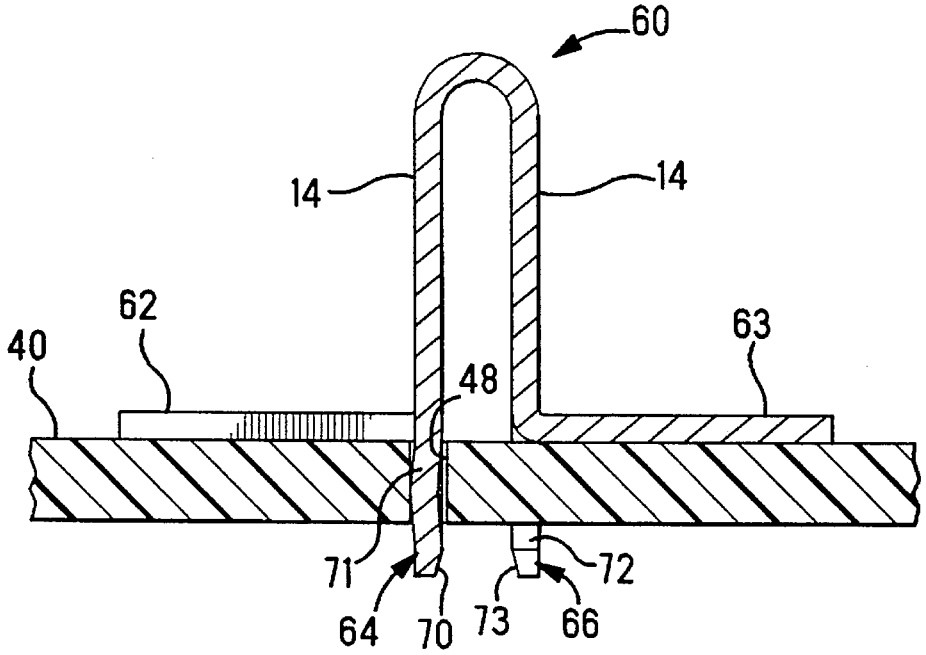
FIG. 9 is a cross-sectional view taken along line 9—9 of FIG. 8.

Solder tab 64 has a straight section 65 and a securing section 69. A slit 68 separates the straight section 65 from the securing section 69. The securing section 69 has a chamfered end 70 which assists in guiding the solder tab into the tab hole on the circuit board. The straight section 65 also has a chamfered end, not shown, which is similar to the chamfered end 70. The securing section 69 further has a bent portion 71. The bent portion 71 secures the solder tab 64 within the tab hole 48 by engaging walls of the tab hole 48, see FIG. 9. The straight section 65 is received in the tab hole 48 for soldering therein and the bent portion 71 is deflected by the walls of the tab hole 48. The pressure of the deflected bent portion 71 secures the solder tab 64 in the tab hole.

Solder tab 66 similarly has a straight portion 72 having a chamfered end 73, a slit 74 which separates the straight portion 72 from the securing section 75. The securing section 75 also has a chamfered end 76 and a bent portion 77 which engages walls of the tab hole 49 to secure the solder tab 66 in the tab hole and to secure the contact to the circuit board 40.

The solder tabs 64,66 and the tab holes 48,49 are orientated in a staggered arrangement. The bent portions 71,77 of the solder tabs 64,66 secure the contact 60 to the circuit board 40 and the stabilization tabs 62,63 act to stabilize the contact onto the board 40. When the contact 60 is secured to the circuit board 40, the contact fingers 20 are positioned over the guide slot 44 of the circuit board. The staggered orientation of the solder tabs 64,66 and the stabilization tabs 62,63 provide the contact 60 with greater stability on the circuit board 40 during mating with the matable connector. This contact 60 can be mounted to the circuit board using soldering only without the need to use screws or other fasteners.

An alternative embodiment of the contact 60 could further have guide tabs which would extend forwardly from the stabilization tabs 62,63. The guide tabs and the contact fingers would extend beyond the edge of the circuit board. The guide tabs would thereby guide a matable contact into electrical connection with the bus bar contact.

The bus bar contact of the present invention and many of its attendant advantages will be understood from the foregoing description. It is apparent that various changes may be made in the form, construction, and arrangement of parts thereof without departing from the spirit or scope of the invention, or sacrificing all of its material advantages.

I claim:

1. A bus bar contact for mounting on a circuit board, comprising:

a U-shaped center section having ends and a front and a back, the U-shaped center section being defined by parallel legs and a curved section, the top of the contact being defined by the curved section;

contact fingers extending from the front of the U-shaped section, said fingers having contact sections for electrical connection with a matable contact, the ends of the U-shaped center section being disposed below the contact fingers;

termination posts extending from the ends of said U-shaped section to be received in holes in the circuit board to be soldered thereto and provide electrical connection therewith;

stabilization tabs extending from the ends of said U-shaped section, the tabs being disposed below the contact fingers to provide stability and support for the contact against the circuit board;

securing means for securing said contact on the circuit board;

guide means for guiding the matable contact into electrical contact with said contact fingers and to prevent damage to the contact fingers.

2. The bus bar contact of claim 1, wherein said securing means is a hole disposed on said tab to secure the contact to the circuit board.

3. The bus bar contact of claim 2, wherein said termination posts extend from the ends of said U-shaped section, the termination posts extending in generally the same direction as legs on the U-shaped section, and said tabs extend perpendicular to said termination posts.

4. The bus bar contact of claim 3, wherein said contact fingers extend from both sides of said U-shaped section, said contact fingers being arranged in an alternating fashion from the U-shaped section, wherein contact fingers on one of the sides is staggered from the contact fingers on another of the sides.

5. The bus bar contact of claim 4, wherein said contact fingers have curved portions and camming surfaces, and a matable contact receiving channel therebetween, the contact fingers are cammed apart when the matable contact is inserted and are resiliently biased thereagainst.

6. The bus bar contact of claim 2, wherein said guide means comprises integral guide tabs extending forwardly from said mounting tabs and being disposed below said contact fingers, thereby defining a guide slot between said guide tabs and is centrally located below said contact fingers to guide a matable contact into electrical connection with said contact fingers and to protect said contact fingers from damage due to improper insertion of the matable contact.

7. The bus bar contact of claim 6, wherein said U-shaped section includes parallel legs, the parallel legs have lances which secure the parallel legs together and strengthen the U-shaped section.

8. The bus bar contact of claim 7, wherein said termination posts extend from the ends of said U-shaped section, the termination posts extending in generally the same direction as legs on the U-shaped section, and said mounting tabs extend perpendicular to said termination posts.

9. The bus bar contact of claim 8, wherein said contact fingers extend from both sides of said U-shaped section, said contact fingers being arranged in an alternating fashion from the U-shaped section, wherein contact fingers on one of the sides is staggered from the contact fingers on another of the sides.

10. The bus bar contact of claim 9, wherein said contact fingers have curved portions and camming surfaces, and a matable contact receiving channel therebetween, the contact fingers are cammed apart when the matable contact is inserted and are resiliently biased thereagainst.

11. The bus bar contact of claim 1, wherein termination posts are solder tabs and said securing means comprises a bent portion of said solder tab, said bent portion engages holes on the circuit board to secure the contact thereto.

12. The bus bar contact of claim 11, wherein said tabs are stabilization tabs and are disposed about the U-shaped section in a staggered orientation to provide greater stability to the contact, one of the tabs being closer to the contact fingers than another of the tabs.

13. The bus bar contact of claim 11, wherein said solder tabs extend from the ends of said U-shaped section, the termination posts extending in generally the same direction as legs on the U-shaped section, and said mounting tabs extend perpendicular to said solder tabs.

14. The bus bar contact of claim 13, wherein said solder tabs comprise a straight section and a securing section with a slit therebetween, said securing section comprises said bent portion.

15. The bus bar contact of claim 14, wherein said solder tabs are disposed in a staggered orientation about the U-shaped portion to provide greater stability.

16. The bus bar contact of claim 15, wherein said contact fingers extend from both sides of said U-shaped section, said contact fingers being arranged in an alternating fashion from the U-shaped section, wherein contact fingers on one of the sides is staggered from the contact fingers on another of the sides.

17. The bus bar contact of claim 16, wherein said contact fingers have curved portions and camming surfaces, and a matable contact receiving channel therebetween, the contact fingers are cammed apart when the matable contact is inserted and are resiliently biased thereagainst.

* * * * *